US009303901B2

(12) United States Patent
Thybo et al.

(10) Patent No.: US 9,303,901 B2
(45) Date of Patent: Apr. 5, 2016

(54) METHOD FOR CONTROLLING A VAPOUR COMPRESSION SYSTEM

(75) Inventors: Claus Thybo, Soenderborg (DK); Rafael Wisniewski, Broenderslev (DK)

(73) Assignee: Danfoss A/S, Nordborg (DK)

( * ) Notice: Subject to any disclaimer, the term of this patent is extended or adjusted under 35 U.S.C. 154(b) by 1366 days.

(21) Appl. No.: 12/663,053

(22) PCT Filed: Jun. 11, 2008

(86) PCT No.: PCT/DK2008/000214

§ 371 (c)(1),
(2), (4) Date: Jun. 16, 2010

(87) PCT Pub. No.: WO2008/151630

PCT Pub. Date: Dec. 18, 2008

(65) Prior Publication Data

US 2010/0269527 A1 Oct. 28, 2010

(30) Foreign Application Priority Data

Jun. 12, 2007 (DK) ..... 2007 00847

(51) Int. Cl.
*F25B 5/02* (2006.01)
*G05D 27/02* (2006.01)
(Continued)

(52) U.S. Cl.
CPC . *F25B 5/02* (2013.01); *F25B 49/02* (2013.01); *F25B 2600/21* (2013.01); *F25B 2600/2511* (2013.01)

(58) Field of Classification Search
CPC ..... F25B 41/04; F25B 2341/064; F25B 2341/065; F25B 2341/06; F25B 2341/066; F25B 2341/0661; F25B 2341/0662; F25B 2341/068; F25B 2341/0683; F25D 2700/10; F25D 2700/12; F25D 2700/02
USPC ..... 62/117, 199, 525, 504, 151–152, 81, 62/190, 200
See application file for complete search history.

(56) References Cited

U.S. PATENT DOCUMENTS 3,099,140 A * 7/1963 Leimbach ..... F25B 41/04 236/92 B
5,052,190 A 10/1991 Gregory
(Continued)

FOREIGN PATENT DOCUMENTS

CN 1512284 A 7/2004
DE 4100749 A1 7/1992
(Continued)

OTHER PUBLICATIONS

R n. N Koury L.Machado, K.A.R.Ismail, Numerical Simulation of Variable Speed Refrigeration System, 2001, Elsevier, International Journal of Refrigeraton (24), 2001, 192-200.*
(Continued)

*Primary Examiner* — Frantz Jules
*Assistant Examiner* — Meraj A Shaikh
(74) *Attorney, Agent, or Firm* — McCormick, Paulding & Huber LLP

(57) ABSTRACT

A method for controlling a vapor compression system, such as a refrigeration system, preferably an air condition system, comprising at least two evaporators. While monitoring a superheat (SH) at a common outlet for the evaporators, the amount of available refrigerant is controlled in response to the SH and in order to obtain an optimum SH value. The available refrigerant is distributed among the evaporators in accordance with a distribution key. The distribution key is preferably obtained while taking individual consideration to operating conditions for each of the evaporators into account. Thereby the vapor compression system can be operated in such a way that each of the evaporators is operated in an optimal manner, and in such a way that the system in general is operated in an optimal manner.

19 Claims, 4 Drawing Sheets

(51) Int. Cl.

| | |
|---|---|
| ***F25B 40/00*** | (2006.01) |
| ***F25D 21/00*** | (2006.01) |
| ***F25B 49/02*** | (2006.01) |

(56) References Cited

U.S. PATENT DOCUMENTS

| | | | | |
|---|---|---|---|---|
| 5,749,238 | A * | 5/1998 | Schmidt | F25B 5/02 62/211 |
| 5,867,998 | A | 2/1999 | Guertin | |
| RE37,630 | E * | 4/2002 | Behr | A47F 3/0408 62/199 |
| 6,546,843 | B2 * | 4/2003 | Ugolini | A23G 9/045 62/331 |
| 2002/0124585 | A1 * | 9/2002 | Bash | F25B 5/02 62/228.4 |
| 2004/0020224 | A1 | 2/2004 | Bash et al. | |
| 2004/0068999 | A1 * | 4/2004 | Jessen | F25B 49/02 62/222 |
| 2004/0144528 | A1 * | 7/2004 | Kunimoto | F24D 17/02 165/298 |
| 2005/0172647 | A1 * | 8/2005 | Thybo | F25D 29/008 62/129 |

FOREIGN PATENT DOCUMENTS

| | | | |
|---|---|---|---|
| EP | 0 282 782 | A2 | 2/1988 |
| EP | 1 707 900 | A1 | 10/2006 |
| GB | 2 215 867 | A | 1/1989 |
| GB | 2432651 | A | 5/2007 |
| JP | 60138378 | A | 7/1985 |
| JP | 1263465 | A | 10/1989 |
| JP | 2075860 | A | 3/1990 |
| JP | 2075861 | A | 3/1990 |
| JP | 2282664 | A | 11/1990 |
| JP | 3137464 | A | 6/1991 |
| JP | 4165249 | A | 6/1992 |
| JP | 6257828 | A | 9/1994 |
| JP | 9273797 | A | 10/1997 |
| WO | 91/08428 | A | 6/1991 |
| WO | 2006/011789 | A | 2/2006 |
| WO | WO 2006097106 | A1 * | 9/2006 |

OTHER PUBLICATIONS

Danish Search Report for Danish Patent Application PA 2007 00847 dated Jan. 21, 2008.

PCT International Search Report for PCT/DK2008/000214 dated Oct. 28, 2008.

* cited by examiner

METHOD FOR CONTROLLING A VAPOUR COMPRESSION SYSTEM

CROSS REFERENCE TO RELATED APPLICATIONS

This application is entitled to the benefit of and incorporates by reference essential subject matter disclosed in International Patent Application No. PCT/DK2008/000214 filed on Jun. 11, 2008 and Danish Patent Application No. PA 2007 00847 filed Jun. 12, 2007.

FIELD OF THE INVENTION

The present invention relates to a method for controlling a vapor compression system, such as a refrigeration system, e.g. an air condition system. More particularly, the present invention relates to a method for controlling a vapor compression system comprising at least two evaporators.

BACKGROUND OF THE INVENTION

In vapor compression systems comprising only one evaporator it is often attempted to control a mass flow of refrigerant supplied to the evaporator in such a manner that the potential refrigeration capacity of the evaporator is utilized to the maximum possible extent. On one hand, a large amount of gaseous refrigerant in the evaporator is undesirable, since it has an adverse effect on the refrigeration capacity of the evaporator because refrigeration takes place due to a phase transition of the refrigerant present in the evaporator. On the other hand, it is undesirable to allow liquid refrigerant to pass through the evaporator, because thereby the full refrigeration capacity of the refrigerant is not utilized, and because it might cause damage to the compressor. It is therefore desirable to control the mass flow of refrigerant to the evaporator in such a manner that a mixed phase of refrigerant, i.e. refrigerant comprising gaseous as well as liquid refrigerant, extents to a position which is as close as possible to an outlet of the evaporator, without allowing liquid refrigerant to pass through the evaporator. To this end the superheat (SH) at the outlet of the evaporator is often measured and used as a control parameter. A high superheat is a sign that too much gaseous refrigerant is present in the evaporator. A superheat which is zero is a sign that liquid refrigerant is allowed to pass through the evaporator. Accordingly, it is often attempted to control the mass flow of refrigerant supplied to the evaporator in such a manner that a minimal, but positive, superheat is obtained.

In vapor compression systems comprising two or more evaporators it may be a challenge to control the flow of refrigerant in the system in such a way that each of the evaporators is operated in an appropriate manner, and in such a way that the vapor compression system in general is operated efficiently, e.g. in the sense described above. More particularly, it is desirable to control such a vapor compression system in such a manner that the SH of each of the evaporators is controlled to be as near to zero as possible without allowing liquid refrigerant to pass through any of the evaporators. Furthermore, it is desirable to do this without significantly increasing the component count of the system.

SUMMARY OF THE INVENTION

It is, thus, an object of the invention to provide a method for controlling a vapor compression system comprising at least two evaporators, the method allowing the potential refrigeration capacity of each evaporator to be utilized to the maximum possible extent.

It is a further object of the invention to provide a method for controlling a vapor compression system comprising at least two evaporators, the method allowing the vapor compression system in general to be operated efficiently.

According to the invention the above and other objects are fulfilled by providing a method for controlling a vapor compression system, the vapor compression system comprising a compressor, a condenser, at least two evaporators fluidly connected in parallel between the compressor and a common outlet, and an expansion device for controlling a flow of refrigerant across each of the evaporators, the method comprising the steps of:

- obtaining a distribution key determining allocation of available refrigerant among the evaporators,
- monitoring a superheat, SH, at the common outlet,
- controlling an amount of available refrigerant in response to the SH, and in order to obtain an optimum SH value,
- distributing the available refrigerant among the evaporators in accordance with the distribution key, and by means of the expansion device.

In the present context the term 'vapor compression system' should be interpreted to mean any system in which a flow of refrigerant circulates and is alternatingly compressed and expanded, thereby providing either refrigeration or heating of a volume. Thus, the vapor compression system may be a refrigeration system, an air condition system, a heat pump, etc.

The compressor may be a single compressor, but it could also be two or more compressors, e.g. forming a compressor rack.

The vapor compression system comprises at least two evaporators arranged in parallel, preferably in such a manner that they provide refrigeration to the same refrigerated volume.

The distribution key determines allocation of available refrigerant among the evaporators. Thus, the distribution key determines, given a certain amount of available refrigerant, how large a portion of the available refrigerant each evaporator shall receive. The distribution key is preferably generated in such a manner that due consideration is taken to special operating conditions of each of the evaporators in order to obtain optimal filling for all of the evaporators. It is preferably possible to adjust the distribution key during operation, e.g. in order to take changes in operating conditions into account on a regular basis. However, the distribution key may alternatively be fixed initially.

Thus, the distribution key may be obtained initially, e.g. supplied by a storage device or a look-up table which does not form part of the vapor compression system, or it may be obtained dynamically, e.g. on the basis of one or more measured quantities.

The expansion device ensures that the available refrigerant is distributed among the evaporators in accordance with the distribution key.

During operation, the SH at the common outlet is monitored. Thus, at the point where the SH is measured, refrigerant which has followed various flow paths, passing the various evaporators, has once again been mixed to form a common refrigerant flow. Accordingly, the monitored SH value is a measure for the performance of the entire vapor compression system, and not for the performance of a single evaporator. The amount of available refrigerant is controlled in response to the monitored SH, and in order to obtain an optimum SH value. As mentioned above, an optimum SH value may be a value which is as low as possible without becoming exactly zero. Thereby it is ensured that the vapor compression system in general is operated in an efficient manner.

Thus, according to the method of the invention, the vapor compression system is controlled in such a manner that it is ensured that the vapor compression system in general is operated in an efficient manner, while it is ensured that the potential refrigeration capacity of each of the evaporators is utilized to the maximum possible extent.

The expansion device may comprise at least one valve. For instance, the expansion device may comprise one valve for each evaporator, in which case opening a valve results in refrigerant being supplied to the evaporator being connected to that valve, and closing a valve prevents such supply of refrigerant. Accordingly, open times and/or degree of opening of the valves provide a distribution of the available refrigerant among the evaporators.

Alternatively or additionally, the expansion device may comprise a multi-valve connected to each of the evaporators in such a manner that, for each evaporator, a time interval during which the multi-valve supplies refrigerant to the evaporator can be adjusted, and the step of controlling an amount of available refrigerant may comprise adjusting said time interval for each of the evaporators in such a manner that the mutual distribution of refrigerant among the evaporators is maintained. According to this embodiment one specially designed valve is used for controlling the supply of refrigerant to all of the evaporators, and this is done in accordance with the distribution key as well as in accordance with the necessary amount of refrigerant in the vapor compression system in order to operate the system in an efficient manner. Thus, the multi-valve controls the amount of available refrigerant as well the distribution of this amount among the evaporators.

The step of controlling an amount of available refrigerant may comprise adjusting the length of a combined time interval during which refrigerant is supplied to one of the evaporators, e.g. within a specific cycle, relatively to the length of a combined time interval during which no refrigerant is supplied to the evaporators within the same cycle. According to this embodiment, the amount of available refrigerant is controlled by adjusting the time where the multi-valve is closed, i.e. not supplying refrigerant to the evaporators, and the time where the multi-valve is open, i.e. supplying refrigerant to one of the evaporators. Thus, if a smaller amount of available refrigerant is desired, the valve should be operated to be closed more of the time, and if a larger amount of available refrigerant is desired, the valve should be operated to be open more of the time. In any event, this adjustment of the combined open/closed times should be performed without altering the mutual distribution of refrigerant among the evaporators, i.e. while maintaining a distribution in accordance with the distribution key.

As mentioned above, the distribution key may be obtained dynamically. Thus, the step of obtaining a distribution key may comprise the steps of:

- operating the expansion device to provide a SH level which is sufficiently high to prevent liquid refrigerant from passing through the evaporators,
- obtaining a first distribution key,
- adjusting the distribution of refrigerant through each of the evaporators to be in accordance with the first distribution key,
- operating the expansion device to lower the SH level, and
- obtaining a second distribution key.

According to this embodiment the distribution key is obtained by initially obtaining a rough or crude distribution key, i.e. the first distribution key, operating the vapor compression system in accordance with the first distribution key, and fine tuning the distribution key to obtain a more optimal distribution key, i.e. obtaining the second distribution key.

The first distribution key is obtained while the SH level is sufficiently high to prevent liquid refrigerant from passing through the evaporators. Thereby it is ensured that the first distribution key does not provide a distribution of the available refrigerant which accidentally allows liquid refrigerant to pass through one or more of the evaporators. Accordingly, the compressor is protected from damage. The high SH level may, e.g., be obtained by reducing the amount of available refrigerant considerably, e.g. by decreasing opening time of the expansion device.

When the distribution of refrigerant through each of the evaporators has been adjusted to be in accordance with the first distribution key, the expansion device is operated to lower the SH level. This may, e.g., be obtained by increasing opening time of the expansion device or by decreasing the refrigeration load on the vapor compression system. Alternatively, it may be done in any other suitable manner.

At this lower SH level the second distribution key is obtained. As mentioned above, this second distribution key may be regarded as an adjustment or fine tuning of the first distribution key.

The procedure described above may be repeated in the sense that a third, fourth, etc. distribution key may be obtained, each distribution key being an adjustment or fine tuning of the preceding distribution key.

The step of obtaining a first distribution key may comprise the steps of:

a) monitoring a superheat, SH, of refrigerant at the common outlet, b) modifying the distribution of refrigerant through the evaporators in such a manner that a mass flow of refrigerant through a first evaporator is altered while keeping the total mass flow of refrigerant through all the evaporators substantially constant, c) when a significant change in SH occurs, detecting a control parameter based on the change in mass flow of refrigerant through the first evaporator obtained during step b), and d) repeating steps a) to c) for each of the remaining evaporator(s), and the step of adjusting the distribution of refrigerant through each of the evaporators to be in accordance with the first distribution key may be performed on the basis of the detected control parameters.

According to this embodiment, the distribution of refrigerant through the evaporators is modified while the SH is monitored. The modification is performed in such a manner that a mass flow of refrigerant through a selected, i.e. a first, evaporator is altered in a specific and controlled manner. Since the total amount of available refrigerant is not altered, the mass flow of refrigerant through the remaining evaporators must be modified to compensate for the controlled modification of the mass flow through the first evaporator. However, the mutual distribution among the remaining evaporators is kept substantially constant.

When a significant change in SH occurs, a control parameter is detected. This control parameter will thereby be significant for the behavior of the first evaporator in response to the performed modification. Thus, the control parameter provides information about operation and performance of that specific evaporator.

A significant change in SH could, e.g., be a sudden increase or decrease in SH. For instance, if the mass flow through the first evaporator is increased, then the SH will decrease significantly when the mass flow is sufficiently large to allow liquid refrigerant to pass all the way through the evaporator. Thus, when such a decrease in SH is detected, a control parameter is detected, and the control parameter thereby provides information about the behavior of the first evaporator during such an event. Ideally the vapor compression system should be operated in such a manner that each of the evaporators receives exactly enough refrigerant to ensure that a mixed gaseous/liquid phase of the refrigerant is present along the entire length of the evaporator without allowing liquid refrigerant to pass through the evaporator. If this can be obtained, the performance of each of the evaporators will be optimal, and the total performance of the vapor compression system can thereby be optimized without increasing the total power consumption of the system. This has been described above. In order to obtain that the potential refrigeration capacity of each of the evaporators is utilized to the greatest possible extent, it is primarily an objective to ensure that the evaporators have substantially identical degrees of filling. Once this has been obtained, it may subsequently be ensured that the mixed phase of the refrigerant is present along the entire length of each evaporator. This may, e.g., be obtained by adjusting the amount of available refrigerant.

By repeating steps a) to c) for each of the remaining evaporator(s), control parameters as described above are obtained for each of the evaporators. Since individual information is obtained for each of the evaporators, it is possible to use the obtained information for adjusting the refrigerant distribution in such a manner that individual characteristics for each evaporator are taken into account. Accordingly, a refrigerant distribution can be chosen which ensures that the potential refrigeration capacity of each of the evaporators is utilized to the maximum extent possible. This is a great advantage because the total power consumption of the vapor compression system may thereby be reduced without reducing the performance of the system.

Furthermore, the individual control parameters for each of the evaporators are obtained using the same measuring equipment, i.e. it is not necessary to install a set of relevant sensors for each of the evaporators. Thereby the component count for the system can be kept at a minimum, and the initial manufacturing costs are thereby also kept at a minimum.

Furthermore, the step of obtaining a second distribution key may comprise the steps of:

a) monitoring a superheat, SH, of refrigerant at the common outlet, b) modifying the distribution of refrigerant through the evaporators in such a manner that a mass flow of refrigerant through a first evaporator is altered while keeping the total mass flow of refrigerant through all the evaporators substantially constant, c) when a significant change in SH occurs, detecting a control parameter based on the change in mass flow of refrigerant through the first evaporator obtained during step b), and d) repeating steps a) to c) for each of the remaining evaporator(s).

According to this embodiment, the second distribution key is obtained using essentially the same procedure as the one described above for obtaining the first distribution key.

Alternatively, the step of obtaining a first distribution key may comprise the steps of:

a) monitoring a superheat, SH, of refrigerant at the common outlet, b) modifying the distribution of refrigerant through the evaporators in such a manner that a mass flow of refrigerant through a first evaporator is altered by a predefined amount while keeping the total mass flow of refrigerant through all the evaporators substantially constant, c) detecting a control parameter based on the change in mass flow of refrigerant through the first evaporator obtained during step b), said control parameter reflecting a change in SH occurring as a result of the modification of the distribution of refrigerant, and d) repeating steps a) to c) for each of the remaining evaporator(s), and the step of adjusting the distribution of refrigerant through each of the evaporators to be in accordance with the first distribution key may be performed on the basis of the detected control parameters.

This is very similar to the method described above, and features which have already been described above will therefore not be described in detail here. Instead reference is made to the description above.

In the method according to this embodiment steps b) and c) are performed in the following manner. First the mass flow of refrigerant through the first evaporator is altered by a predefined amount, i.e. in a known and controlled manner. This may be performed by increasing or decreasing the mass flow of refrigerant through the first evaporator by a fixed amount. Alternatively, it may be performed by varying the flow of refrigerant through the first evaporator in a known and controlled manner, e.g. following a sinusoidal pattern. During this, the mass flow of refrigerant through each of the remaining evaporators is also altered to compensate for the change in mass flow through the first evaporator, thereby keeping the total mass flow of refrigerant through all of the evaporators substantially constant. Furthermore, the SH is monitored during this step.

When the distribution of refrigerant has been modified as described above, a control parameter is detected. The control parameter reflects a change in SH occurring as a result of the modification of the distribution of refrigerant. The control parameter being detected may be found in the following manner. If the temperature of refrigerant is measured as a function of the length of an evaporator it will be found that the temperature of the refrigerant is substantially constant in parts of the evaporator where refrigerant is present in a liquid phase or in a mixed liquid/gaseous phase. At the position of the evaporator where the mixed phase ends and a purely gaseous phase starts, the temperature of the refrigerant starts increasing, and the increase in temperature continues until the outlet of the evaporator is reached. In the beginning the slope of the temperature curve is relatively steep, but the temperature will approach the temperature of the ambient air asymptotically, i.e. the slope will decrease as a function of position along the evaporator.

Accordingly, if the point where the mixed phase stops and the gaseous phase starts is relatively close to the outlet of the evaporator, a change in refrigerant supply, and thereby in the position of said point, must be expected to have a relatively significant impact on the temperature of refrigerant at the outlet. On the other hand, if said point is relatively far from the outlet, the impact on the refrigerant temperature at the outlet must be expected to be somewhat smaller, maybe even insignificant. A measured difference in temperature of refrigerant at the common outlet will therefore provide information as to how close to the outlet the point where the mixed phase stops and the gaseous phase starts is positioned. Since it is desired that said point is as close to the outlet as possible without allowing liquid refrigerant to pass through the evaporator, a measured temperature difference is a suitable control parameter.

Furthermore, the step of obtaining a second distribution key may comprise the steps of:

a) monitoring a superheat, SH, of refrigerant at the common outlet, b) modifying the distribution of refrigerant through the evaporators in such a manner that a mass flow of refrigerant through a first evaporator is altered by a predefined amount while keeping the total mass flow of refrigerant through all the evaporators substantially constant, c) detecting a control parameter based on the change in mass flow of refrigerant through the first evaporator obtained during step b), said control parameter reflecting a change in SH occurring as a result of the modification of the distribution of refrigerant, and d) repeating steps a) to c) for each of the remaining evaporator(s).

According to this embodiment the second distribution key is obtained using essentially the same procedure as the one described above for obtaining the first distribution key.

The method may further comprise the steps of:

comparing the detected control parameters for each of the evaporators, and in the case that the detected control parameter of an evaporator is significantly different from the detected control parameters of the remaining evaporators, generating a failure warning signal to an operator.

If the control parameter of one of the evaporators differs significantly from the control parameter(s) of the remaining evaporator(s), or if it is simply significantly different from what is expected, this may be a sign that this evaporator is not functioning in a proper manner. The evaporator may, e.g., be failing, it may be dirty, or it may need defrost. In any event, generating a failure warning to an operator will draw the attention of the operator, and he or she may then investigate the cause of the difference in detected control parameters, and possibly take the necessary actions to solve any problem.

Thus, the method may further comprise the step of initiating defrost of the evaporator having a significantly different control parameter upon generation of a failure warning signal. This step may be initiated manually by an operator establishing that the generated failure warning signal is occasioned by a need for defrost of the evaporator in question. Alternatively, the step may be automatically initiated, e.g. in the case that the difference in control parameters fulfills certain criteria being known to indicate that defrost is needed. This opens the possibility of performing partial defrost of the vapor compression system by temporarily closing off the supply of refrigerant to the relevant evaporator while the remaining evaporators continue operating, preferably in such a manner that the total performance of the vapor compression system is not reduced, or is only reduced insignificantly. Thereby defrost can be performed without affecting the operation of the system.

The method may further comprise repeating the step of obtaining a second distribution key. According to this embodiment, the distribution key, and thereby the refrigerant distribution, is repeatedly adjusted, and it is thereby ensured that the refrigerant distribution remains optimal. The step of obtaining a second distribution key may be repeated at predetermined time intervals, such as regularly every hour, every 15 minutes, every 5 minutes, etc., depending on expected variations in operating conditions for the vapor compression system. The steps may even be repeated continuously.

Alternatively, repetition of the step of obtaining a second distribution key may be initiated by a superheat controller. According to this embodiment, the superheat controller may be capable of detecting signs indicating that the distribution of refrigerant among the evaporators is not optimal. This may, e.g., be that it is difficult for the superheat controller to keep the SH substantially constant. The superheat controller may, e.g., detect that the SH oscillates or cycles, i.e. that the variance of the SH increases. This may be an indication that at least one of the evaporators allows liquid refrigerant to pass through, at least periodically. Allowing liquid refrigerant to pass through one of the evaporators will cause an abrupt decrease in SH, and when liquid refrigerant no longer passes through the evaporator, the SH will abruptly increase again. Such a problem may be relieved by adjusting the distribution of refrigerant among the evaporators. Accordingly, it is advantageous if the superheat controller can 'request' an adjustment, i.e. initiate the step of obtaining a second distribution key, if a situation as described above occurs. As an alternative, the superheat controller may initiate the step of obtaining a second distribution key if a known change in operating conditions occurs. For instance, if a flow of secondary fluid across the evaporators, e.g. a flow of air in the case that the vapor compression system is an air condition system, is altered, then the superheat controller may initiate the step of obtaining a second distribution key in order to cause an adjustment of the distribution of refrigerant, the adjustment compensating such known alterations. In this case the initiation of the step of obtaining a second distribution key may be regarded as part of a feed forward strategy.

The method may further comprise the steps of:

obtaining information relating to at least one disturbance of the vapor compression system, deriving at least one parameter from the obtained information, and controlling the amount of available refrigerant in accordance with the derived parameter(s), and in such a manner that expected consequences of the disturbance(s) are taken into account.

According to this embodiment, known disturbances of the system are taken into account when the amount of available refrigerant is controlled. Such disturbances may be or comprise detected variations in ambient conditions, e.g. ambient temperature, or they may be or comprise modifications to one or more operating parameters performed manually or automatically by the system. In the latter case an expected impact on the operation of the vapor compression system from the modifications may be taken into account even before changes in the operating conditions occur. In any event, expected variations may be taken into account before the system is able to detect that it is necessary to adjust the amount of available refrigerant as a consequence of a disturbance. Thereby the amount of available refrigerant can be controlled in a proactive manner using a feed-forward approach. To this end a known relation between a measurable disturbance and the behavior of the evaporators is used for compensating the amount of available refrigerant when a disturbance is detected or it is known that a disturbance is about to occur.

The obtained information may comprise inlet temperature of a secondary fluid flow flowing across the evaporators. The secondary fluid flow flows across the evaporators in such a manner that it receives refrigeration or heating from the evaporators during operation of the vapor compression system. The fluid flow may be in the form of a flow of liquid, air, slush ice, etc., depending on the type of vapor compression system and the specific application. For instance, in the case that the vapor compression system is an air condition system, the secondary fluid flow will typically be a flow of air circulated across the evaporators in order to obtain a desired temperature in a room where the air condition system is positioned.

A change in inlet temperature of the secondary fluid flow is an indication that the refrigeration capacity necessary in order to obtain a desired outlet temperature of the secondary fluid flow must also be expected to change. For instance, if the vapor compression system provides refrigeration and the inlet temperature of the secondary fluid flow decreases, then less refrigeration capacity will be needed in order to maintain a desired temperature. On the other hand, if the inlet temperature of the secondary fluid flow increases, then it must be expected that more refrigeration capacity is needed to maintain the desired temperature.

Alternatively or additionally, the obtained information may comprise a flow rate of a secondary fluid flow across the evaporators. In the case that the secondary fluid flow is a flow of air, the flow rate may be determined by the rotational speed of a fan arranged in the flow path of the secondary fluid flow, e.g. immediately adjacent to the evaporators. Such a fan may blow or push air across the evaporators. Accordingly, the information relating to the flow rate of the secondary fluid flow may be or comprise information about the rotational speed of such a fan, e.g. information about a change in rotational speed of the fan. A higher rotational speed of the fan results in an increased mass flow of the secondary fluid flow. Thus, the heat transfer for the evaporator increases, and more heating/cooling of the ambient environment is obtained. In the case that the secondary fluid flow is a flow of liquid, a similar situation could be obtained using a pump instead of a fan. As an alternative, the flow rate may be directly measured, e.g. by means of a flow meter.

Alternatively or additionally, the obtained information may comprise a change in pressure of a secondary fluid flowing across the evaporators. As seen from the controller, a disturbance of this kind results in additional heat entering the evaporators. The feed-forward factor compensates this disturbance by calculating the corresponding additional mass flow of refrigerant.

The step of controlling the amount of available refrigerant may comprise multiplying the mass flow of refrigerant by a feed-forward factor, said feed-forward factor being obtained on the basis of the derived parameter(s).

The step of controlling an amount of available refrigerant may be performed in such a manner that a minimal and positive SH value is obtained. As mentioned above, this ensures that the vapor compression system is operated in such a manner that the potential refrigeration capacity of each evaporator, as well as of the entire system, is utilized to the maximum possible extent, while it is prevented that liquid refrigerant passes through one or more of the evaporators.

The method may further comprise the step of closing off refrigerant supply to at least one evaporator, thereby lowering a suction pressure of the vapour compression system. This embodiment of the invention is particularly useful in the case that the vapour compression system is an air condition system. In this case the increased dehumidification of the refrigerated volume can be obtained without increasing the refrigeration capacity. This is obtained in the following manner. When the refrigerant supply to one of the evaporators is closed off, the suction pressure of the vapour compression system decreases until a new equilibrium point is found. This causes the total mass flow of refrigerant in the closed loop system, i.e. the evaporators with the feedback controller, and thereby the amount of available refrigerant, to decrease. However, the decrease in total mass flow does not completely amount to the amount of refrigerant which was previously supplied to the evaporator which no longer receives refrigerant. Therefore the refrigerant supply to each of the remaining evaporators increases, and this causes the surface temperature of each of these evaporators to decrease. Therefore increased condensation takes place at the surfaces of the remaining evaporators, and therefore an increased dehumidification is obtained without increasing the refrigeration capacity of the system.

The present invention may be applied in various types of refrigeration systems, including systems which have been constructed in a centralized manner, as well as systems which have been constructed in a decentralized manner. In the present context the term 'systems which have been constructed in a centralized manner' should be interpreted to mean systems, where one or more centrally positioned compressors supply refrigerant to multiple refrigeration sites. Examples of such systems include systems of the kind which is normally used in supermarkets, or of the kind used in certain industrial refrigeration systems.

Similarly, in the present context the term 'systems which have been constructed in a decentralized manner' should be interpreted to mean systems, where one or more compressors supply refrigerant to a single refrigeration site. Examples of such systems include refrigeration containers, air condition systems, etc.

BRIEF DESCRIPTION OF THE DRAWINGS

The invention will now be described in further detail with reference to the accompanying drawings in which.

DETAILED DESCRIPTION OF THE PREFERRED EMBODIMENTS

Figure 1:
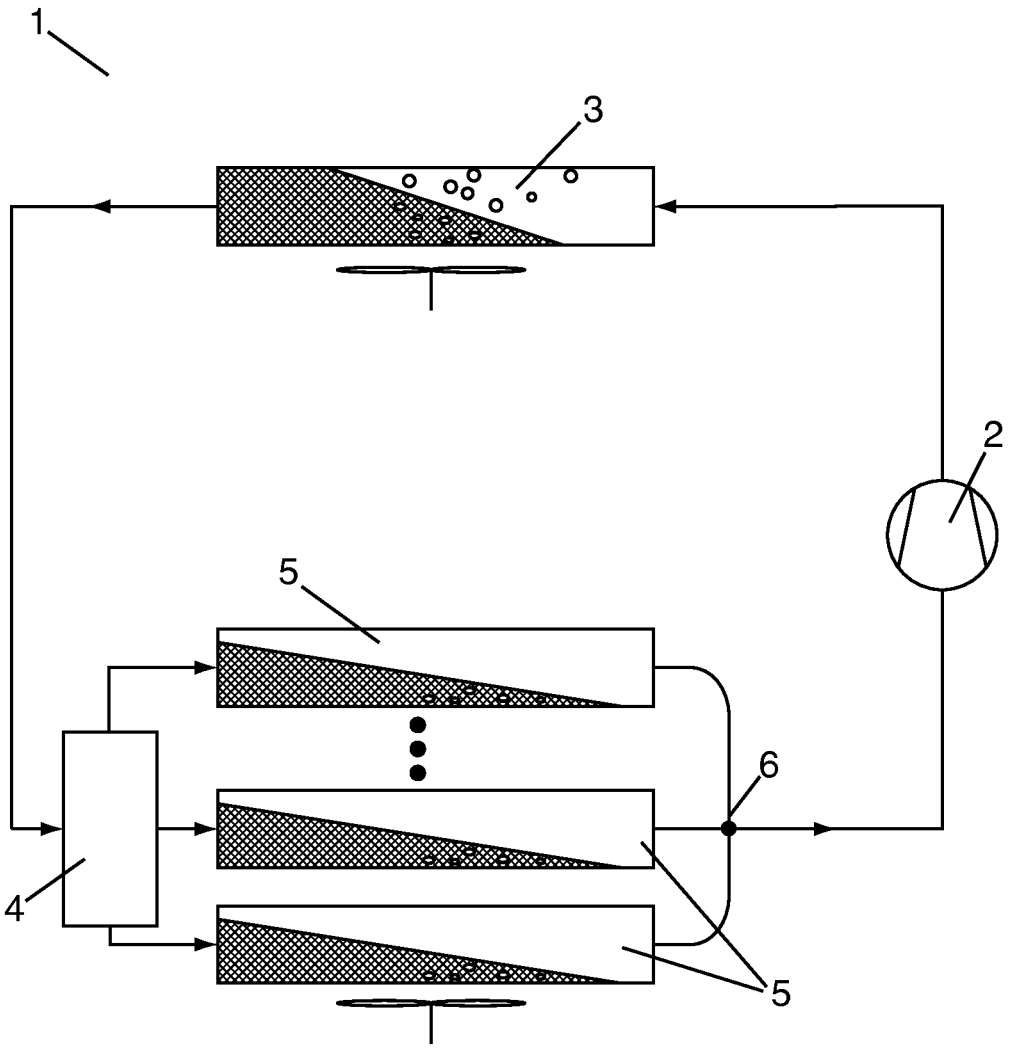
FIG. 1 is a diagrammatic view of a vapour compression system for use in a method according to an embodiment of the invention.

FIG. 1 is a diagrammatic view of a vapor compression system 1, such as a refrigeration system. The vapor compression system 1 comprises a compressor 2, a condenser 3, a valve 4 and a number of evaporators 5 (three of which are shown) connected to form a refrigerant circuit. The evaporators 5 are connected in parallel between the valve 4 and a common outlet 6 fluidly connected to the compressor 2, and the condenser 3 is coupled in series between the compressor 2 and the valve 4.

The valve 4 is of a kind which is capable of distributing refrigerant to each of the evaporators 5 in accordance with a distribution key which has previously been defined.

At the common outlet 6, or immediately downstream of the common outlet 6, a temperature sensor (not shown) is preferably arranged for measuring the temperature of refrigerant at this position. Thus, at the point of the temperature sensor, refrigerant which has passed through the various evaporators 5 has once again been mixed, and it is therefore the temperature of this mixed refrigerant which is measured. This measured temperature is used for monitoring the superheat (SH) at the common outlet, and the monitored SH is used when controlling the vapor compression system as described above.

Figure 2:
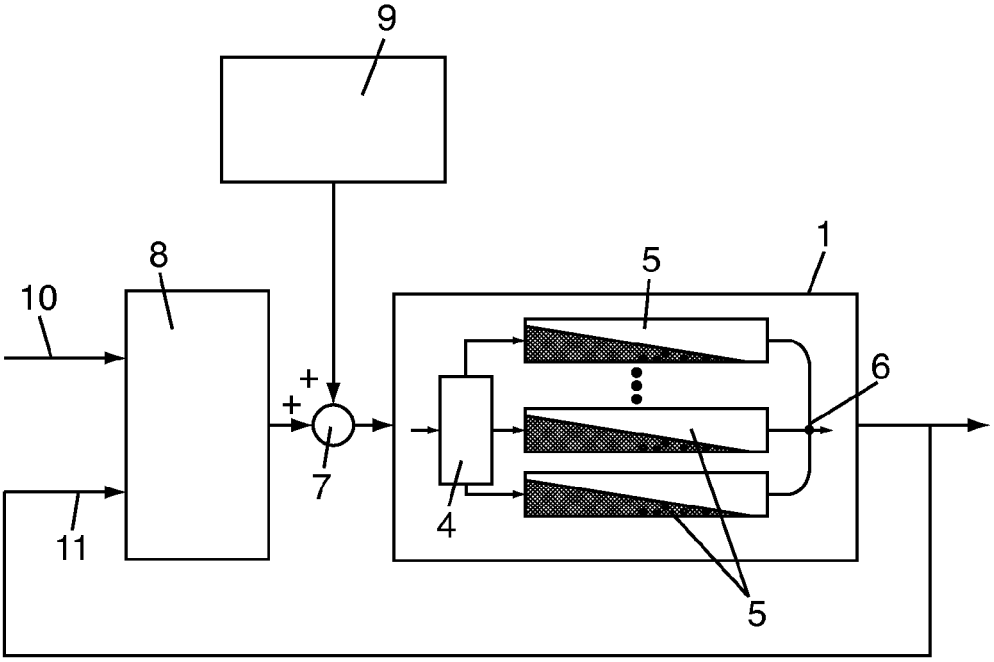
FIG. 2 is a diagrammatic view of part of the vapor compression system of FIG. 1 and illustrating a control strategy according to an embodiment of the invention.

FIG. 2 is a diagrammatic view of part of the vapor compression system 1 of FIG. 1 and illustrating a control strategy according to an embodiment of the invention.

The control system illustrated in FIG. 2 comprises a summation unit 7 adapted to communicate control signals to the vapor compression system 1, in particular to the valve 4. The summation unit 7 receives input signals from a feedback unit 8 and from a feed-forward unit 9.

The feedback unit 8 receives a reference signal via communication line 10. The reference signal may advantageously provide information relating to a desired SH level for the vapor compression system 1. The feedback unit 8 further receives a feedback signal via communication line 11. The feedback signal provides information relating to a quantity measured at or near the common outlet 6. The measured quantity could advantageously be the refrigerant temperature at the common outlet 6 or a measured value of the SH level at the common outlet 6. Based on the signals received via the communication lines 10, 11 the feedback unit 8 generates an input signal for the summation unit 7, the input signal providing information relating to whether or not the measured quantity is in accordance with the reference value, and, if this is not the case, the size and sign of the deviation. Based on this input signal the summation unit 7 calculates the required modification to the operation of the vapor compression system 1 and sends the necessary control signals to the relevant components of the system 1.

The feed-forward unit 9 stores information relating to known disturbances of the vapor compression system 1. The feed-forward unit 9 may receive information relating to such disturbances from one or more sensors capable of detecting certain types of disturbances. Alternatively or additionally, the feed-forward unit 9 may receive information relating to certain types of disturbances from relevant components of the control system, such as a controller controlling rotational speed of a fan causing a secondary flow of air across the evaporators 5. This has already been described above. Based on the stored information the feed-forward unit 9 generates an input signal for the summation unit 7. Based on this input signal the summation unit 7 calculates the modification to the operation of the vapor compression system 1 which is required in order to compensate the impact on the operation of the system 1 caused by the disturbance(s). The summation unit 7 then sends appropriate control signals to relevant components of the system 1.

Thus, the vapor compression system 1 shown in FIG. 2 is operated in accordance with a feedback control strategy, and with due consideration to known disturbances of the vapor compression system 1, i.e. in accordance with a feed-forward control strategy.

Figure 3:
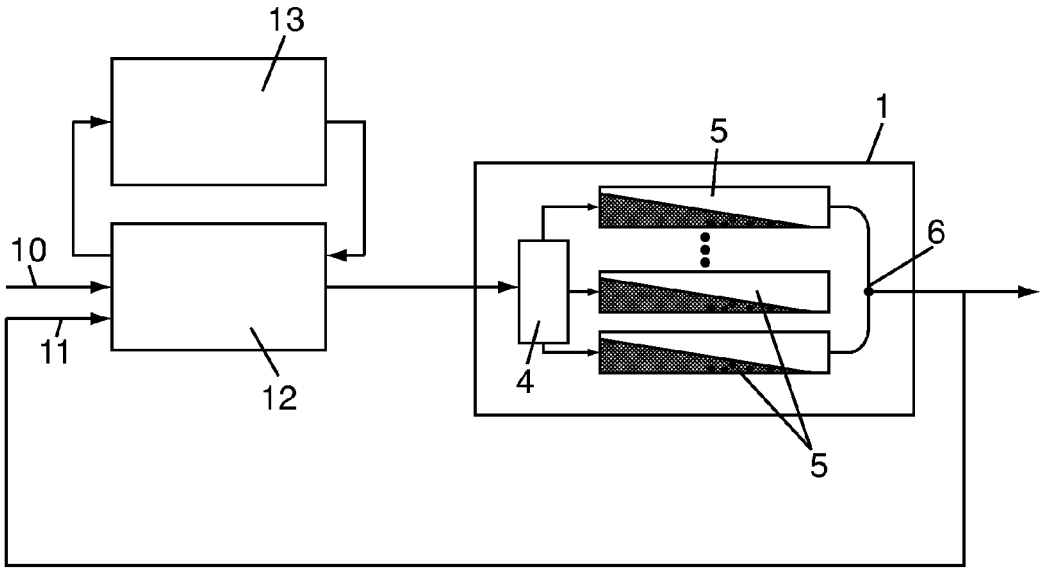
FIG. 3 is a diagrammatic view of part of the vapor compression system of FIG. 1 and illustrating a control strategy according to another embodiment of the invention.
Figure 4:
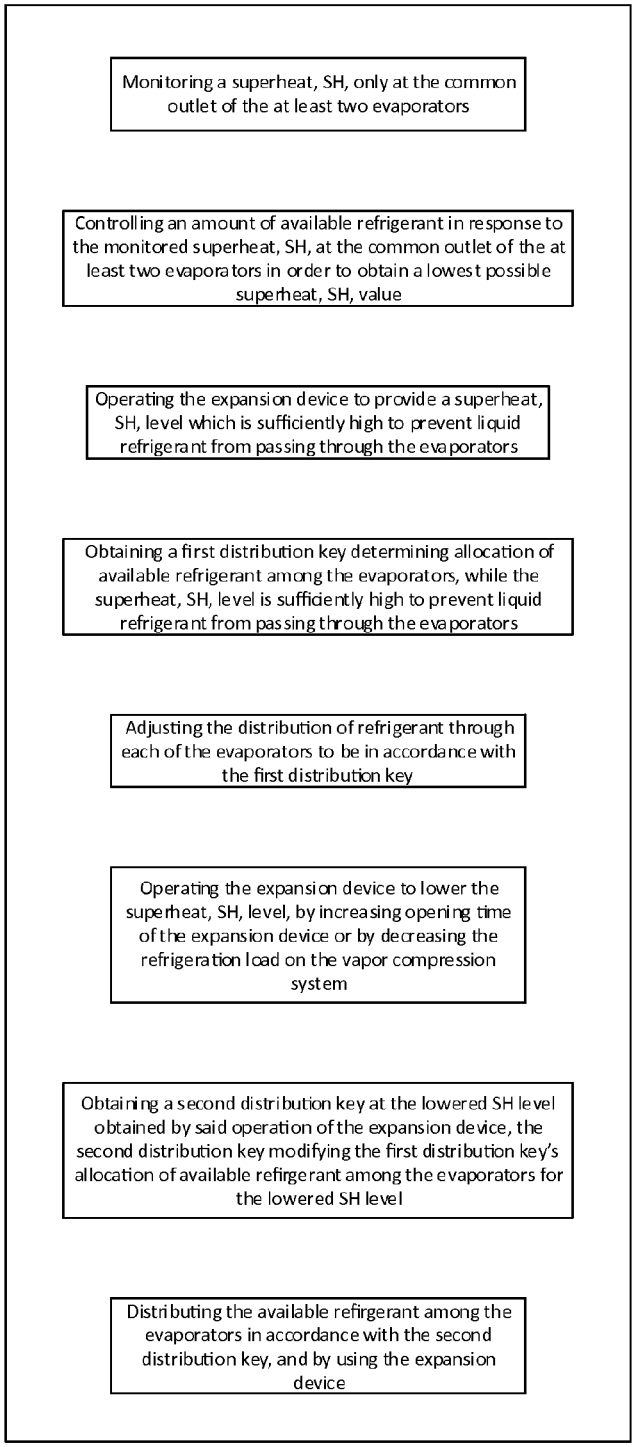
FIG. 4 is a flow chart depicting a method for controlling the vapor compression system of claim 1.

FIG. 3 is a diagrammatic view of part of the vapor compression system 1 of FIG. 1 and illustrating a control strategy according to another embodiment of the invention.

The control system illustrated in FIG. 3 comprises a control unit 12 and an adaptation unit 13. The control unit 12 is adapted to communicate control signals to the vapor compression system 1, in particular to the valve 4. The control unit 12 receives a reference signal via communication line 10. The reference signal may advantageously provide information relating to a desired SH level for the vapor compression system 1. The control unit 12 further receives a feedback signal via communication line 11. The feedback signal provides information relating to a quantity measured at or near the common outlet 6. The measured quantity could advantageously be the refrigerant temperature at the common outlet 6 or a measured value of the SH level at the common outlet 6. Finally, the control unit 12 receives an adaptation signal from the adaptation unit 13. The adaptation signal provides information relating to the distribution key, including modifications to the distribution key. Thus, the adaptation unit 13 stores information relating to the distribution key, performs necessary adjustments to the distribution key and communicates the current or valid distribution key to the control unit 12.

Based on all this information, the control unit 12 generates a control signal and communicates this to the vapor compression system 1. Thus, the vapor compression system 1 is controlled on the basis of information regarding whether or not the measured quantity is in accordance with the reference value, and on the basis of information relating to the distribution key.

Furthermore, the control unit 12 generates a feedback signal and communicates this to the adaptation unit 13. Based on this feedback signal the adaptation unit 13 calculates necessary adjustments to the distribution key. When the distribution key is adjusted, the adjusted distribution key is communicated to the control unit 12 as described above. The feedback signal is preferably generated while taking the feedback signal received via communication line 11 into account. Thereby the distribution key is adjusted in accordance with the impact on the measured quantity as explained previously.

Thus, the vapor compression system 1 shown in FIG. 3 is operated in accordance with a feedback control strategy as well as in accordance with a distribution key stored and adjusted by the adaptation unit 13. Furthermore, the distribution key is adjusted in accordance with a feedback control strategy.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for controlling a vapor compression system, the vapor compression system comprising a compressor, a condenser, at least two evaporators fluidly connected in parallel between the compressor and an expansion device comprising a multi-valve connected to each of the evaporators for controlling a flow of refrigerant across each of the evaporators, the at least two evaporators sharing a common outlet fluidly connected to the compressor, the method comprising the steps of:

monitoring a superheat, SH, only at the common outlet of the at least two evaporators;

controlling an amount of available refrigerant in response to the monitored superheat, SH, at the common outlet of the at least two evaporators; and operating the expansion device to provide a superheat, SH, level which is sufficiently high to prevent liquid refrigerant from passing through the evaporators;

obtaining a first distribution key determining the relative allocation of available refrigerant among each of the evaporators, while the superheat, SH, level is sufficiently high to prevent liquid refrigerant from passing through the evaporators;

adjusting the relative allocation of available refrigerant through each of the evaporators to be in accordance with the first distribution key;

operating the expansion device to lower the superheat, SH, level, by increasing opening time of the expansion device or by decreasing the refrigeration load on the vapor compression system;

obtaining a second distribution key at the lowered SH level obtained by said operation of the expansion device, the second distribution key modifying the first distribution key's relative allocation of available refrigerant among each of the evaporators for the lowered SH level; and distributing the available refrigerant among each of the evaporators in accordance with the second distribution key's relative allocation of available refrigerant by using the expansion device.

2. The method according to claim 1, wherein the expansion device comprises at least one valve.

3. The method according to claim 1, wherein for each evaporator, a time interval during which the multi-valve supplies refrigerant to the evaporator can be adjusted, and wherein the step of controlling an amount of available refrigerant comprises adjusting said time interval for each of the evaporators in such a manner that the mutual distribution of refrigerant among the evaporators is maintained.

4. The method according to claim 3, wherein the step of controlling an amount of available refrigerant comprises adjusting the length of a combined time interval during which refrigerant is supplied to one of the evaporators relatively to the length of a combined time interval during which no refrigerant is supplied to the evaporators.

5. The method according to claim 1, wherein the step of obtaining a first distribution key comprises the steps of:

a) modifying the distribution of refrigerant through the evaporators in such a manner that a mass flow of refrigerant through a first evaporator is altered while keeping the total mass flow of refrigerant through all the evaporators substantially constant;

b) when a significant change in superheat, SH, occurs, detecting a control parameter based on the change in mass flow of refrigerant through the first evaporator obtained during step b), the significant change in SH being either one of: 1) a mass flow through an evaporator being increased, the SH then decreasing significantly when the mass flow is sufficiently large to allow liquid refrigerant to pass all the way through the evaporator, or 2) a mass flow through an evaporator being decreased, the SH then increasing significantly when the mass flow is sufficiently small to prevent liquid refrigerant to pass all the way through the evaporator; and c) repeating steps a) to c) for each of the remaining evaporator(s), wherein the step of adjusting the distribution of refrigerant through each of the evaporators to be in accordance with the first distribution key is performed on the basis of the detected control parameters.

6. The method according to claim 1, wherein the step of obtaining a second distribution key comprises the steps of:

a) modifying the distribution of refrigerant through the evaporators in such a manner that a mass flow of refrigerant through a first evaporator is altered while keeping the total mass flow of refrigerant through all the evaporators substantially constant, b) when a significant change in superheat, SH, occurs, detecting a control parameter based on the change in mass flow of refrigerant through the first evaporator obtained during step b), the significant change in SH being either one of: 1) a mass flow through an evaporator being increased, the SH then decreasing significantly when the mass flow is sufficiently large to allow liquid refrigerant to pass all the way through the evaporator, or 2) a mass flow through an evaporator being decreased, the SH then increasing significantly when the mass flow is sufficiently small to prevent liquid refrigerant to pass all the way through the evaporator, and c) repeating steps a) to c) for each of the remaining evaporator(s).

7. The method according to claim 1 wherein the step of obtaining a first distribution key comprises the steps of:

a) modifying the distribution of refrigerant through the evaporators in such a manner that a mass flow of refrigerant through a first evaporator is altered by a predefined amount while keeping the total mass flow of refrigerant through all the evaporators substantially constant, b) detecting a control parameter based on the change in mass flow of refrigerant through the first evaporator obtained during step b), said control parameter reflecting a change in superheat, SH, occurring as a result of the modification of the distribution of refrigerant, and c) repeating steps a) to c) for each of the remaining evaporator(s), and wherein the step of adjusting the distribution of refrigerant through each of the evaporators to be in accordance with the first distribution key is performed on the basis of the detected control parameters.

8. The method according to claim 1, wherein the step of obtaining a second distribution key comprises the steps of:

a) modifying the distribution of refrigerant through the evaporators in such a manner that a mass flow of refrigerant through a first evaporator is altered by a predefined amount while keeping the total mass flow of refrigerant through all the evaporators substantially constant, b) detecting a control parameter based on the change in mass flow of refrigerant through the first evaporator obtained during step b), said control parameter reflecting a change in superheat, SH, occurring as a result of the modification of the distribution of refrigerant, and c) repeating steps a) to c) for each of the remaining evaporator(s).

9. The method according to claim 5, further comprising the steps of:

comparing the detected control parameters for each of the evaporators, and in the case that the detected control parameter of an evaporator is significantly different from the detected control parameters of the remaining evaporators, generating a failure warning signal to an operator.

10. The method according to claim 9, further comprising the step of initiating defrost of the evaporator having a significantly different control parameter upon generation of a failure warning signal.

11. The method according to claim 1, further comprising repeating the step of obtaining a second distribution key.

12. The method according to claim 1, further comprising the steps of:

obtaining information relating to at least one disturbance of the vapor compression system, deriving at least one parameter from the obtained information, and controlling the amount of available refrigerant in accordance with the derived parameter(s), and in such a manner that expected consequences of the disturbance(s) are taken into account.

13. The method according to claim 12, wherein the obtained information comprises inlet temperature of a secondary fluid flow flowing across the evaporators.

14. The method according to claim 12, wherein the obtained information comprises a flow rate of a secondary fluid flow across the evaporators.

15. The method according to claim 12, wherein the obtained information comprises a change in pressure of a secondary fluid flowing across the evaporators.

16. The method according to claim 12, wherein the obtained information comprises a change in rotational speed of a fan driving a secondary fluid flow across the evaporators.

17. The method according to claim 12, wherein the step of controlling the amount of available refrigerant comprises multiplying the mass flow of refrigerant by a feed-forward factor, said feed-forward factor being obtained on the basis of the derived parameter(s).

18. The method according to claim 1, wherein the step of controlling an amount of available refrigerant is performed in such a manner that a minimal and positive superheat, SH, value is obtained.

19. The method according to claim 1, further comprising a step of closing off refrigerant supply to at least one evaporator, thereby lowering a suction pressure of the vapor compression system.

* * * * *